US005107775A

United States Patent [19]

Langlais et al.

[11] Patent Number: 5,107,775

[45] Date of Patent: Apr. 28, 1992

[54] ADJUSTABLE LEGS FOR DESK AND THE LIKE

[76] Inventors: Sylvain Langlais, 120 A Rang 10; Robert Cusson, 245 Chemin O'Brien, both of Lefebvre, Canada, J0H 2C0

[21] Appl. No.: 695,901

[22] Filed: May 6, 1991

[51] Int. Cl.[5] ..... A47B 9/00

[52] U.S. Cl. ..... 108/144; 248/188.5; 248/157

[58] Field of Search ..... 108/144, 106, 96, 147; 248/188.8, 188.9, 157, 188.5

[56] References Cited

U.S. PATENT DOCUMENTS

| | | | |
|---|---|---|---|
| 761,468 | 5/1904 | Ford | 108/144 |
| 1,947,801 | 2/1934 | Russell | 108/144 X |
| 2,585,111 | 2/1952 | Grauer | 108/144 X |
| 2,586,724 | 2/1952 | Sannebeck | 108/144 X |
| 2,831,739 | 4/1958 | Fryckholm | 248/188.5 |
| 3,229,790 | 1/1966 | Shayne | 108/144 X |
| 3,356,327 | 12/1967 | Schreyer et al. | 248/188.8 X |
| 3,523,702 | 8/1970 | Unti et al. | 108/144 X |
| 3,595,180 | 7/1971 | Swoyer | 108/144 X |

*Primary Examiner*—Peter A. Aschenbrenner
*Attorney, Agent, or Firm*—Roland L. Morneau

[57] ABSTRACT

A school desk has legs adapted to be lengthened for raising the desk. The legs are provided with a sleeve adapted to fittingly slide on the legs. The legs have a transversal perforation, and the sleeves have a set of vertically disposed holes. A screw and nut combination is used to lock the sleeves on the legs at selected vertical positions. The sleeves are vertically grooved to facilitate their sliding action and to allow the screw and nut combination to positively lock the sleeves on the legs.

5 Claims, 2 Drawing Sheets

FIG. 1
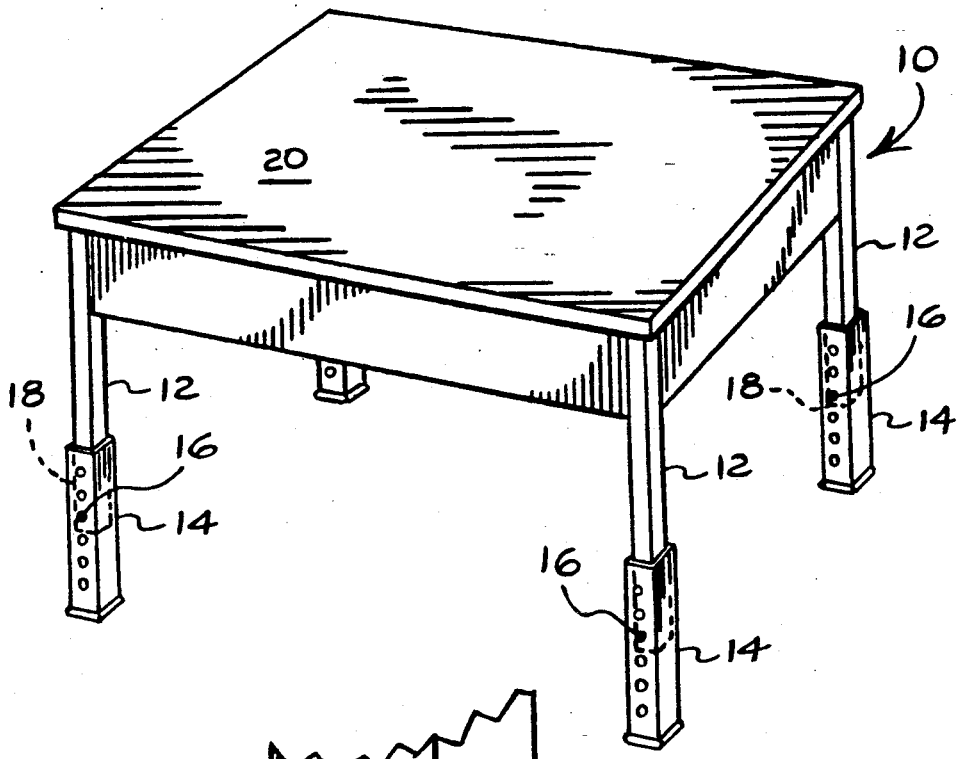
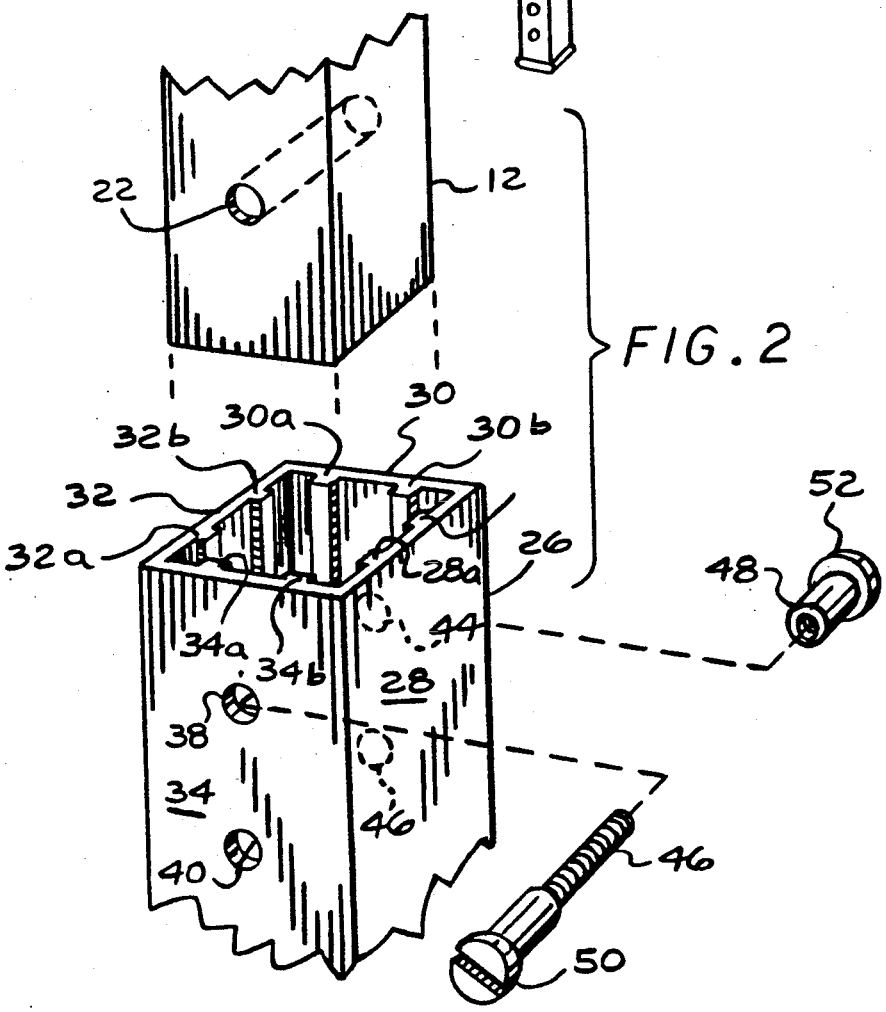
FIG. 2

ADJUSTABLE LEGS FOR DESK AND THE LIKE

BACKGROUND OF THE INVENTION

1. Field of the Invention

The present invention relates to school desks and chairs adjustable in height and in particular to legs for desk which can vary in length.

Furniture for primary schools requires considerable storage space because the pupils and students using them do not have, year after year, the same stature. Furthermore, the same school may have different repartition of pupils among the different grades.

It is an object of the invention to change the height of desks and chairs so that a minimal number of such pieces of furniture be needed to accommodate a plurality of the corresponding numbers of students regardless of their height.

It is another object of this invention to adapt existing equipment to meet the requirements of adjustability. The present invention can be implemented by cutting the legs of presently available desks and chairs and providing suitable extentions for them.

2. Prior Art

The search performed by the applicants has revealed two Canadian patents directed to means for adjusting the height of school desks. In Canadian patent No. 739,251, a pair of telescopic tubes is described with a displacing means consisting of a combination of a toothed rack and ratched wheel mounted on the tubes to adjust the height of the desk and to lock the tubes in a fixed position.

In Canadian patent No. 764,304 the school desk is vertically adjustable. The legs of the desk consist of two coaxial tubes which are vertically adjustable by means of a screw spindle and a pair of bevelled pinions fixed at the upper end of the screw spindle.

The prior art discloses complex mechanical arrangements which are expensive and do not allow the conversion of conventional wooden desks into desks having adjustable heights.

SUMMARY OF THE INVENTION

The adjustable desk according to the present invention makes use of a rectangular cross sectional leg having a relatively short height and a sleeve member having four lateral walls forming an internal cross-section substantially corresponding to the cross-section of the leg for allowing the sleeve member to fittingly slide over the leg. The sleeve member is provided with a set of vertically spaced holes in diametrically opposed walls which are selectively aligned with a perforation extending perpendicularly across the leg at a location adjacent the lower end thereof. A screw and nut combination adapted to fittingly slide through both the perforation and the holes longitudinally locks the sleeve and the leg while applying pressure on the walls of the sleeve member over the leg.

The sleeve member is particularly adapted to easily slide over the leg by providing at least two longitudinal ribs on the inner surface of each of the walls for allowing a better sliding control of the sleeve member over the leg.

The screw and nut combination is preferably mounted through a central vertical axis of the leg between two internal ribs to provide a more positive locking action of the screw and nut combination.

Considering that the sleeve may be long and that the legs may be extended up to a relatively important height, the legs are fixed to the frame of the desk with a bracket adapted to solidify the leg to the desk per se.

BRIEF DESCRIPTION OF THE DRAWINGS

FIG. 1 is a perspective view of a desk according to the present invention,

FIG. 2 is an exploded view of a tubular member adapted to be mounted on a leg and locked by a screw and nut combination.

DETAILED DESCRIPTION OF THE INVENTION

Figure 3:
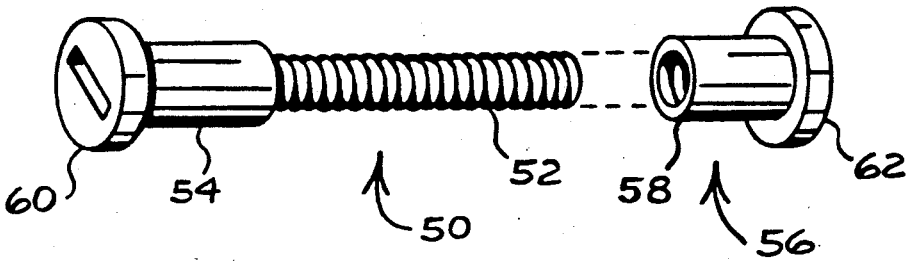
FIG. 3 illustrates a perspective view of a screw and nut combination suitable for locking the tubular member over the leg.

FIG. 1 illustrates a desk 10 having four legs 12, each leg being supported by a tubular member 14. The tubular member 14 is locked to the leg 12 by a screw and nut combination 16 which maintains the bottom 18 of the leg 12 above the ground. The height of the top surface 20 of the desk can be adjusted by selectively positioning the bottom of the leg 18 at a different level in the tubular members 14.

FIG. 2 illustrates a preferred embodiment of the invention. The leg 12 which is provided with a perforation across the center of the cross-section of the leg 12 is located at a distance adjacent its lower end 24 and generally at a distance of about three inches.

Although the internal cross-section of the tubular member 14 corresponds to the outer cross-sectional dimension of the leg 12, for slidingly fitting over the latter, in the embodiment shown in FIG. 2, the tubular member 26 which has four lateral walls 28, 30, 32 and 34 is provided with ribs **28*a* and 28*b* on wall 28, ribs 30*a* and 30*b* on wall 30, ribs 32*a* and 32*b* on wall 32 and ribs 34*a* and 34*b* on wall 34. The inner surface of the ribs forms a contour which corresponds to the outer contour of the leg 12 to allow a smooth sliding operation of the leg 12 inside the tubular member 26. All the ribs have preferably a flat surface facing the leg 12 for maintaining a more positive contact with the leg 12**. Ribs having a thickness of about 0.1 to 0.2 inches is sufficient for legs of about 2 inches square.

The ribs on each wall are preferably set by pairs equally spaced on each side of the vertical central line of each wall. This disposition is particularly preferred for their relation with the holes such as 38 and 40 which are vertically aligned midway between the two ribs **34*a* and 34*b*. This disposition also applies to the holes such as 44 and 46 located through the wall 30 diametrically opposed to the wall 34. The hole 44 is horizontally aligned with the hole 38 as well as hole 46 which is aligned horizontally with holes 40. Each of the holes on wall 34 has a corresponding hole through the wall 30**.

When the sleeve 26 is mounted over the leg 12 and holes 40 and 46 are aligned with the perforation 22 in the leg 12, the screw 46 is introduced in a hole 38 and the perforation 22 and the nut 48 is introduced in the hole 44 and the perforation 22 and are treadedly engaged to each other. The screw 46 is provided with a head 50 and the nut 48 is provided with a head 50 so that the tightening of the screw in the nut will provide a pressure on the walls 34 and 30 towards the leg 12. This pressure is located between the ribs 30*a* and 30*b* and between the ribs 34*a* and 34*b* so that a slight concave effect is produced on the walls 30 and 34 for providing an additional and more positive locking effect between the tubular member 26 and the leg 12.

The legs 12 are generally made of wood and the sleeve members such as 26 are preferably made of plastic such as polyethylene of high density which is wear-resistant and provides a low coefficient of friction for its contact with leg 12. The type of screw and nut used is illustrated in FIG. 3. The screw 50 has a threaded portion 52 which is partly covered by a plastic sleeve 54 having a diameter corresponding to the internal diameter of the holes such as 38 and perforation 12. The nut 56 has an internally threaded shaft 58 which also have an outer contour corresponding the inner contour of the hole 44 and the perforation 22. The diameter of the plastic sleeve 54 and the shaft 58 prevents the leg from vibrating inside the tubular sleeve 26. The screw 50 has a head 60 similar to the head 62 provided for the nut 56 for applying an internally directed pressure on the walls of the tubular sleeves as explained above. A slot is additionally provided in the head 60 as well as in the head 62 (not shown) for facilitating the tightening of the screw 50 in the nut 56.

Figure 4:
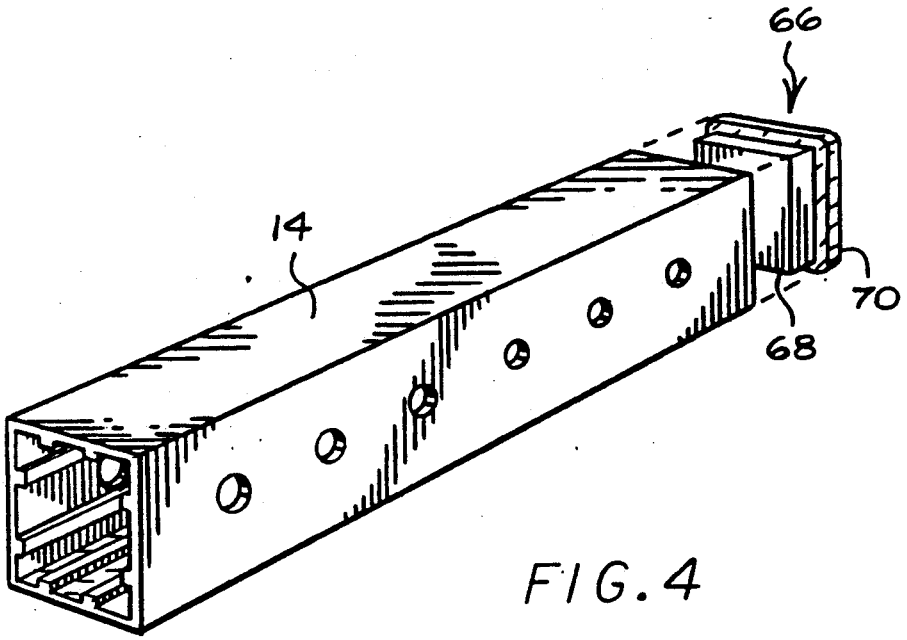
FIG. 4 is a perspective view of a tubular member provided with a set of vertically disposed holes and a resting plate for contacting the ground.

FIG. 4 shows an embodiment of the tubular sleeve 14 which is provided with a footing member 66. A portion of the footing member 66 has a contour so as to be fittingly secured inside the leg 14 while the portion 70 exceeds laterally under the walls of the leg for providing a more widely dispersed pressure over the ground supporting a desk and in particular leg 14.

Figure 5:
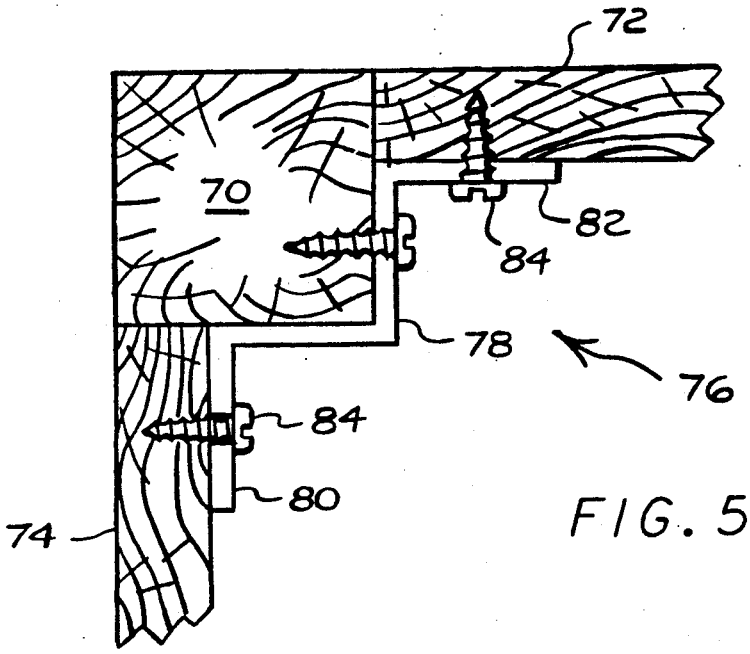
FIG. 5 is a bottom view of a corner of the desk illustrating a particular means for fixing the leg.

Considering that the legs 12 are provided with extensions which provides additional leverage action on the legs relative to the desk, the leg 70 such as shown in FIG. 5 is connected to the lateral skirt members 72 and 74 pending under the top surface 20 by a bracket 76 forming a right angle portion 78 adapted to contact two internally facing lateral sides of the leg 70 and two flanges 80 and 82 laterally contacting the inner surface of the skirt members 72 and 74. The bracket 76 is fixed to the leg 70 and the skirt members 72 and 74 with screws 84. The bracket 76 is preferably made of rigid metal.

We claim:

1. A school desk having at least three legs adapted to be lengthened for raising the height of the desk, said legs having a rectangular cross-section and a perforation extending perpendicularly across the legs at a location adjacent the lower end thereof, a sleeve member having four lateral walls forming an internal cross-section substantially corresponding to the cross-section of the legs for allowing the sleeve members to fittingly slide over said legs, said lateral walls are provided with at least two longitudinal vertical ribs on the inner surface of each of said walls, said ribs having a thickness to fittingly contact said legs, said sleeve members being provided wiht a set of vertically spaced holes, in diametrically opposed walls, a screw and nut combination adapted to fittingly slide through said perforation and holes, for longitudinally locking said sleeves on said legs, said screws and nuts each having a head for applying pressure on said walls over said legs.

2. A school desk as recited in claim 1, wherein the holes are centrally located on each opposed walls and the ribs are evenly disposed on each side of said holes, the head of each screw and nut adapted to interiorly curve the opposed walls upon pressure exerted by said heads.

3. A school desk as recited in claim 2, wherein the ribs have a rectangulr cross-section, the long axis of the ribs being parallel to the surface of the walls.

4. A school desk as recited in claim 3, wherein said desk has legs of about 14 inches high with a perforation at about 3 inches from its lower end, the height of the sleeve members being about 15 inches high and the holes are vertically spaced by about two inches, the uppermost hole being located to provide an overlapping between each leg and each sleeve member of about four inches.

5. A school desk as recited in claim 2, wherein the sleeve members are made of plastic having a low coefficient of friction and the screw and nut combination are at least partly sheated longitudinally to fill the cross-section of the perforations and the holes.

* * * * *